US010266774B2

(12) United States Patent
Flores, III et al.

(10) Patent No.: US 10,266,774 B2
(45) Date of Patent: Apr. 23, 2019

(54) FEEDSTOCK CONVERSION TO FUEL ON HIGH PRESSURE CIRCULATING FLUIDIZED BED

(71) Applicant: Southwest Research Institute, San Antonio, TX (US)

(72) Inventors: Eloy Flores, III, San Antonio, TX (US); Monica R. Medrano, San Antonio, TX (US); Hsiang Y. Lai, San Antonio, TX (US); Michael P. Hartmann, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 272 days.

(21) Appl. No.: 14/506,279

(22) Filed: Oct. 3, 2014

(65) Prior Publication Data

US 2016/0096994 A1 Apr. 7, 2016

(51) Int. Cl.

*C07C 1/00* (2006.01)
*C10G 1/00* (2006.01)
*C10G 1/08* (2006.01)

(52) U.S. Cl.

CPC ..... *C10G 1/002* (2013.01); *C10G 1/08* (2013.01); *C10G 1/086* (2013.01)

(58) Field of Classification Search

CPC ..... C10G 1/002; C10G 3/50; C10G 3/55
USPC ..... 585/240, 241, 242
See application file for complete search history.

(56) References Cited

U.S. PATENT DOCUMENTS 5,081,083 A * 1/1992 Wright ..... B01J 23/64 502/324
7,955,508 B2 6/2011 Allan et al.
7,998,315 B2 8/2011 Bridgwater et al.
8,100,990 B2 1/2012 Ellens et al.
8,545,581 B2 10/2013 Agblevor
2009/0082604 A1* 3/2009 Agrawal ..... C01B 3/042 585/242
2010/0063271 A1* 3/2010 Allan ..... B01J 3/008 536/124
2010/0256428 A1 10/2010 Marker et al.
2011/0258914 A1* 10/2011 Banasiak ..... C10B 49/10 44/307

(Continued)

FOREIGN PATENT DOCUMENTS

EP 2417222 A1 2/2012
WO WO 2010129170 A2 * 11/2010 ..... C10B 49/22
WO 2013134391 A1 9/2013

OTHER PUBLICATIONS

Huang, T-J.; Jhao, S-Y. "Ni—Cu/samaria-doped ceria catalysts for steam reforming of methane in the presence of carbon dioxide", Appl. Cat. A., 302 (2006), pp. 325-332.*

(Continued)

*Primary Examiner* — Philip Y Louie
*Assistant Examiner* — Aaron W Pierpont
(74) *Attorney, Agent, or Firm* — Grossman, Tucker et al.

(57) ABSTRACT

There is provided a process and systems for producing fuels via pyrolysis of carbonaceous feedstock under pressure and temperature in an efficient manner using a circulating fluidized bed with catalyst(s). The pressure and temperature are selected to provoke supercritical conditions, and pyrolysis, hydropyrolysis, hydrotreating, and optionally reforming treatment of the carbonaceous feedstock is carried out simultaneously in one reactor on a recirculating fluidized bed containing catalysts.

20 Claims, 4 Drawing Sheets

(56) References Cited

U.S. PATENT DOCUMENTS

| | | | | |
|---|---|---|---|---|
| 2012/0060418 | A1* | 3/2012 | Epstein | B01J 23/462 48/127.7 |
| 2012/0214113 | A1* | 8/2012 | Kulprathipanja | F27B 15/02 432/18 |
| 2013/0214207 | A1 | 8/2013 | Gharda | |
| 2013/0232856 | A1 | 9/2013 | Clingan | |
| 2014/0073822 | A1 | 3/2014 | Wei et al. | |
| 2014/0100395 | A1* | 4/2014 | Felix | C10G 1/002 585/240 |
| 2015/0065764 | A1* | 3/2015 | Daudin | C08H 8/00 585/242 |

OTHER PUBLICATIONS

Li, S. et. al. Hydrogen production by biomass gasification in supercritical water with bimetallic Ni—M/γ—Al2O3 (Year: 2011).*

D. Dayton, et al; "Biomass Hydropyrolysis in a Pressurized Fluidized Bed Reactor"; Energy&Fuels, ACS Publications 2013 (2 pgs); <<http://pubs.acs.org/doi/abs/10.1021/ef400355t>> (accessed May 28, 2014).

A. Lappas, et al; "Biomass Pyrolysis in a Circulating Fluid Bed Reactor for the Production of Fuels and Chemicals"; Fuel 81 (2002) pp. 2087-2095.

D. Meier, et al; "Pyrolysis and Hydropyrolysis of Biomass and Lignins—Activities at the Institute of Wood Chemistry in Hamburg, Germany"; Preprints of Papers—American Chemical Society Division Fuel Chemistry 40 (1995): pp. 298-298. <<http://web.anl.gov/PCS/acsfuel/preprint%20archive/Files/40_2_ANAHEIM_04-95_0298>> (accessed May 28, 2014).

R.H. Venderbosch, et al; "Stabilisation of Biomass Derived Pyrolysis Oils by Catalytic Hydrotreatment" (28 pgs) <<http://www.biocoup.com/fileadmin/user/december/Update_December_2011/101_RUG_BTG_March11>> (accessed May 28, 2014).

* cited by examiner

FEEDSTOCK CONVERSION TO FUEL ON HIGH PRESSURE CIRCULATING FLUIDIZED BED

TECHNICAL FIELD

The present invention relates to a process for the treatment of a carbonaceous feedstock to produce fuels and systems for conducting such processes.

BACKGROUND

Carbonaceous feedstocks such as biomass (biological material derived from living or recently living organisms), residuum, heavy oils (density or specific gravity higher than light crude oil such as an API gravity of less than 20) and relatively high organic content material may be converted to biooils or pyrolysis oils using pyrolysis in a circulating fluidized bed with an inert atmosphere or hydropyrolysis in an ebulating or fluidized bed with catalyst and hydrogen present. Such pyrolysis methods create products that contain relatively unstable oils or biofuels with unwanted heteroatoms, such as oxygen, sulfur, and nitrogen. These heteroatoms must then be hydrotreated in one or more subsequent stages to be removed from the oils or biofuel.

Accordingly, there is a need for better processes for efficiently producing biofuel such as pyrolysis oils that are relatively less polluting to the environment from selected carbonaceous feedstocks.

SUMMARY

The present invention produces fuels through pyrolysis of a carbonaceous feedstock under high pressure in an efficient manner using a circulating fluidized bed. Under high pressure, pyrolysis, hydropyrolysis, hydrotreating, and optionally reforming treatment of the carbonaceous feedstock may be carried out simultaneously in one reactor of a fluidized bed containing catalysts.

In an embodiment, the process of the invention for the production of fuels includes providing in a reaction vessel a carbonaceous feedstock, a lift gas mixture of inert gas and startup hydrogen, a fluidized bed of inert particulate solids and hydrogenation catalyst and pyrolyzing the carbonaceous feedstock to form fuel products. In some embodiments, the process is conducted under temperature and pressure so as to establish supercritical conditions of at least one component of the reactor components, such as water. In some embodiments, pyrolyzing the carbonaceous feedstock includes conducting simultaneous pyrolysis, hydropyrolysis hydrotreating, and optionally reforming of the carbonaceous feedstock. In certain embodiments, the fluidized bed comprises a particulate solid material selected from silica, sand, alumina, silicon, ceramic, zeolite, such as ZSM-5, $CeO_2$, $ZrO_2$, $Al_2O_3$, C, $TiO_2$, $SiO_2$, and oxides or carbonates of Na, K and Mg. In certain embodiments, the catalyst is selected from the group consisting of zirconium/platinum or zirconium/palladium catalyst alloy which may be supported. Other catalyst include noble metals such as Rh, Pd, Pt, Ru, Pt—Cu, Ni—Cu, $CoMoS_2$, $NiMoS_2$, $MoO_3$, $CrO_3$, $WO_3$, $ZrO_2$, Ag, Ge, Re, Os, Li, Na, K. Mg, Ir, Ni, Cu and other transition metals.

In some embodiments, pyrolyzing the carbonaceous feedstock forms solid, liquid, and gas products and further includes separating solid products from liquid and gas products. In certain embodiments, separating is conducted in a cyclone. In other embodiments, the process further includes burning solid products to regenerate the inert solids and catalysts.

In some embodiments, the process further includes sulfiding the catalyst to regenerate the catalyst. In certain embodiments, the sulfiding is conducted in the presence of a sulfiding agent selected from the group consisting of hydrogen sulfide, dimethyl sulfide, dimethyl disulfide (DMDS), and carbon disulfide.

In certain embodiments, the carbonaceous feedstock is selected from biomass containing cellulose or lignocellulose. In certain embodiments, the biomass is selected from corn kernels, husks or stovers, crop stalks or straws from sugarcane, bagasse, switchgrass, corn, wheat, soy, sorghum, hemps, bamboo, algae, and seaweeds. In other embodiments, the biomass is selected from trees, wood chips, barks, and yard clippings. In yet other embodiments, the carbonaceous feedstock is selected from waste plastics, residuum, heavy oil, or high organic content material.

In other embodiments, the process of the invention provides for the continuous production of fuels. Such process includes providing in a reaction vessel a carbonaceous feedstock, a lift gas mixture of inert gas components and hydrogen, water, a fluidized bed of inert particulate solids and a hydrogenation catalyst. This may then be followed by pyrolyzing the carbonaceous feedstock to form fuel product components under temperature and pressure so as to establish supercritical conditions of temperature and pressure of at least one component of the carbonaceous feedstock, lift gas, hydrogen, water or biofuel product, wherein the biofuel product includes solid, liquid and gas products. This may then be followed by separating the solid products from said liquid and gas products and burning the solid products and recovering heat wherein the heat is transferred to said reaction vessel. As above, the pyrolyzing comprises simultaneous pyrolysis, hydropyrolysis, hydrotreating and optionally reforming of the carbonaceous feedstock to form the fuel.

BRIEF DESCRIPTION OF THE DRAWINGS

These and other features and advantages will be better understood by reading the following detailed description, taken together with the drawings wherein.

DETAILED DESCRIPTION

The present disclosure is directed at treatment of a carbonaceous feedstock with a combination of pyrolysis, hydropyrolysis, hydrotreating, and optionally reforming in a relatively high-pressure circulating, fluidized bed. Such process as described herein presents a relatively efficient procedure that is capable of upgrading the carbonaceous feedstock to a relatively higher quality and more refined fuel and can accomplish this objective in a relatively energy-efficient manner. A fuel herein is understood as a fuel that contains energy from carbon fixation (conversion of carbon dioxide into organic compounds). In addition, the process provides relatively reduced sour gas emissions (i.e. emissions of gas containing hydrogen sulfide or $H_2S$) and results in a pyrolysis product that has relatively reduced heteroatom content.

The carbonaceous feedstock that may be employed as a starting material herein may be first understood as a carbon based feedstock. The feedstock also is one that includes heteroatoms, which is reference to the presence of atoms other than hydrogen or carbon. Typically, heteroatoms in the feedstock will include oxygen, nitrogen and sulfur. The carbonaceous feedstock may include biomass (biological material derived from living or recently living organisms). The feedstock may therefore contain cellulose ($C_6H_{10}O_5$) or lignocellulose which contains carbohydrate polymers and an aromatic polymer (e.g. lignin). The feedstock may also have moisture content in the range of 0% by weight to 97% by weight.

Accordingly, the carbonaceous feedstock may contain wood from growing trees, including forest, yard and mill waste such as trees, wood chips, barks, yard clippings, and sawdust, agricultural crops or agricultural waste such as corn kernels, husks or stovers, crop stalks or straws from sugarcane, bagasse, switch grass, corn, wheat, soy, sorghum, hemps, bamboo, algae, seaweeds, waste plastics, petroleum crude oil constituents, or high organic content material. The feedstock may also include water.

Figure 1:
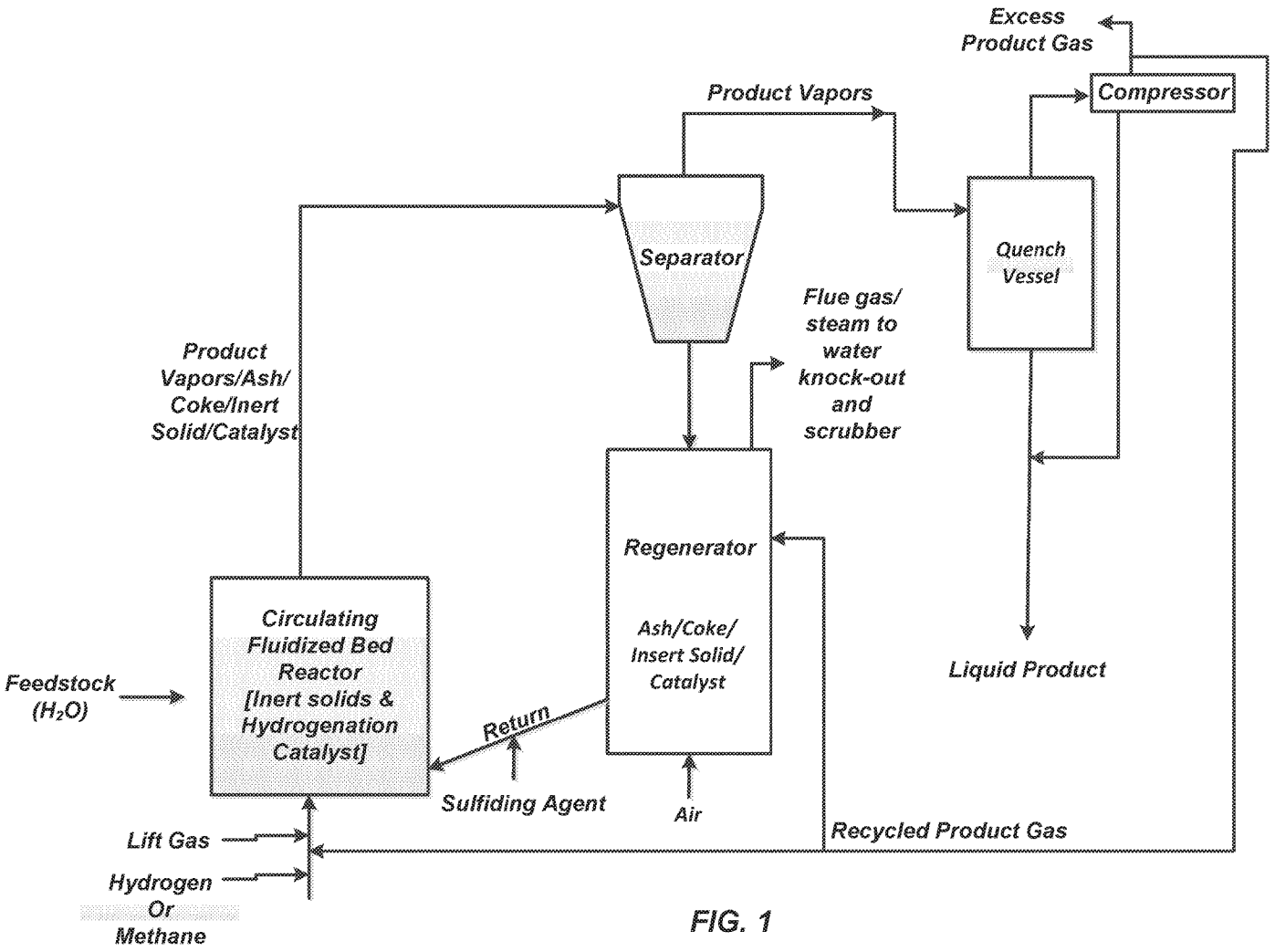
FIG. 1 is a schematic/descriptive overview of a manufacturing installation for conducting an embodiment of the process of the invention.

Attention is directed to FIG. 1 which provides a schematic/descriptive overview of the present disclosure. As can be seen, the above referenced feedstock is preferably introduced via atomizing jets into a circulating fluidized bed reactor where it forms atomized droplets. The feedstock may be introduced at various points of the reactor, but preferably, is introduced at the base of the reactor. One may also add hydrogen or methane.

The circulating fluidized bed reactor contains inert solids and a hydrogenation catalyst. The feed simultaneously undergoes pyrolysis, hydropyrolysis, hydrotreating and optionally and also simultaneously reforming in the reactor as it travels upwardly with the inert solids/hydrogenation catalyst mixture and steam (from water), turning into a fuel precursor, which also vaporizes. The hydrogen, present at a pressure in the range of 1000 psig to 3500 psig, will react and saturate any organic free radicals present which will then promote a relatively higher yield of product oil and saturated hydrocarbon products. The hydrogen also reduces coke production by termination of any polymerization reactions. The residence time of the feedstock in the reactor is in the range of less than or equal to 5.0 seconds and the pressure in the reactor, including the aforementioned hydrogen pressure, is preferably at or above 1000 psig (pounds per square inch gauge) and more preferably in the range of 1000 psig to 3500 psig (from about 5 MPa to about 25 MPa). The use of such pressures in the fluidized bed reactor is such that it allows for at least one of the components in the reactor to become supercritical. This is reference to the feature that a component in the reactor is at a temperature and pressure above its critical point, where distinct liquid and gas phases do not exist, as discussed more fully herein.

As also shown in FIG. 1, the output product vapors along with ash, coke and any inert solid catalyst is then introduced into one or more separators, such as a cyclone separator, which separates the product vapors from the ash, coke, inert solids and catalyst mixture. Such mixture is introduced into the regenerator which creates heat in the regenerator that may be returned to the circulating fluidized bed reactor. In addition, the regenerator may remove water vapor which may have adhered to the catalyst resulting in catalyst deactivation, lowering its activity. This procedure therefore allows for the use of feedstock with relatively higher water content, such as a water content in the range of 0% by weight to 97% by weight as noted above. In addition, as illustrated in FIG. 1, upon return of the ash/coke and inert solid/catalyst to the reactor, one may optionally introduce a sulfiding agent in the return line. This may then serve to reactivate the catalyst in the reactor. Sulfiding agents may include, e.g., hydrogen sulfide and dimethyl disulfide (DMDS).

In addition, the isolation of ash/coke and inert solids/catalyst in the regenerator will create heat in the regenerator that can be transferred as illustrated upon return to the circulating fluidized bed reactor to provide heat for pyrolysis and reactions (pyrolysis, hydropyrolysis, hydrotreating). The inert solids/catalyst will enter the regenerator with solid coke (carbon), which is a byproduct of the indicated reactions. At the high temperature in the regenerator (600° C.+), the carbon will combust to form CO and/or $CO_2$ and water. The temperature is controlled by the amount of air and carbon in the regenerator. Temperatures greater than 680° C. increase the amount of $CO_2$ present (at 680° C.+, CO will combust to form $CO_2$ and water). These combustion reactions are exothermic. The heat created from the combustion reaction is absorbed by the inert solids/catalyst. This heat is then carried into the reactor where it is used for pyrolysis and reactions. The amount of heat contemplated for return to the reactor from the regenerator is such that no heat is necessary to be supplied to the regenerator.

The separator also serves to direct product vapors to a quench vessel wherein the products are further separated or the quenched material may be recycled as a co-feed to the reactor. In addition, flue gases and steam may be removed from the regenerator which may then be forwarded to a water knock-out device or a scrubber.

The inert solids for use in the reactor may include particulate materials such as silica, sand, alumina, silicon, ceramic, zeolite, such as ZSM-5, $CeO_2$, $ZrO_2$, $Al_2O_3$, C, $TiO_2$, $SiO_2$, and oxides or carbonates of Na, K and Mg. The inert solids are preferably present at a particle size in the range of 50 μM to 500 μm, more preferably 200 μm to 300 μm. The catalyst is preferably a hydrogenation catalyst which may be selected according to the particular feedstock that is introduced. Preferably, the hydrogenation catalyst comprises a zirconium/platinum or zirconium/palladium catalyst alloy which may be supported. Other catalyst include noble metals such as Rh, Pd, Pt, Ru, Pt—Cu, Ni—Cu, $CoMoS_2$, $NiMoS_2$, $MoO_3$, $CrO_3$, $WO_3$, $ZrO_2$, Ni, Ag, Ge, Re, Os, Li, Na, K, Mg, Ir, Ni, Cu and other transition metals. Preferably, the catalyst will be 1-20% by wt. of the zeolite HZSM-5, or 5-20% by weight of Ni/Pt or a transition metal on $ZrO_2$, or 5-20% by weight of Ni/Pt on $CeO_2$, or 0.5-1 wt. % $Na_2CO_3$. The catalyst may also include 5-20% by weight Ni/Pt/Pd or a transition metal on $SiO_2/Al_2O_3$ in about a 30:60 ratio of $SiO_2/Al_2O_3$.

As noted, in the circulating fluidized bed reactor, the feedstock is simultaneously exposed to pyrolysis, hydropyrolysis, hydrotreating, and optionally reforming. As understood herein, pyrolysis means the reaction of an organic material in the carbonaceous feedstock exposed to heat in an inert or oxidation free environment that thermally breaks chemical bonds in the organic material. Hydropyrolysis means pyrolysis of the carbonaceous feedstock in a reducing environment, specifically with hydrogen. During hydropyrolysis, the hydrogen reacts with thermally created free radicals. In addition, hydrogen reacts with heteroatoms to produce byproducts such as water. This occurs when reacting hydrogen with the heteroatom oxygen (may occur with or without catalyst). The added hydrogen atoms on the carbon radicals produce more stable and valuable liquid products.

Hydrotreating is that situation where hydrogen specifically reacts catalytically with heteroatoms present in the carbonaceous feedstock to remove heteroatoms such as nitrogen, sulfur and oxygen and metals from the organic molecules present. For example oxygen is removed as water, sulfur as hydrogen sulfide, and nitrogen as ammonia. Hydrotreating replaces heteroatoms with hydrogen atoms on the carbon radicals and also saturates olefins with hydrogen. Hydrotreating occurs at lower temperatures because the catalyst lowers the activation energy of the reaction. The levels of heteroatoms in the fuel produced herein may be as follows: oxygen (≤1000 ppm); nitrogen (≤15 ppm); sulfur (≤3000 ppm). For the production of biofuel to serve as diesel fuel the level of sulfur may be specifically reduced to ≤15 ppm.

Reforming herein, may be understood as steam methane reforming, which is the reaction of a hydrocarbon such as methane with water to produce carbon monoxide and hydrogen. This may be facilitated by the presence of a steam reformation catalyst. Such catalyst may include nickel (Ni) as the active metal or Ni-M compositions, where M=gold (Au), silver (Ag), tin (Sn), copper (Cu), cobalt (Co), molybdenum (Mo), iron (Fe), gadolinium (Gd) or boron (B). One may also rely upon palladium (Pd) or platinum (Pt) as the steam reformation catalyst.

The environment with the reactor is configured so that at least one component of the carbonaceous feedstock, lift gas, hydrogen, water or fuel product that is formed is supercritical. Supercritical conditions for some of the other potential components in the reactor are presented in Table 1.

TABLE 1

Supercritical Conditions of Components in Reactor

| Liquid Phase | Critical Temperature (K) | Critical Pressure (atm) | Critical Pressure (MPa) |
|---|---|---|---|
| Hydrogen (H) | 33.3 | 12.8 | 1.29 |
| Nitrogen (N) | 126 | 33.5 | 3.39 |
| Argon (Ar) | 151 | 48.5 | 4.92 |
| Methane ($CH_4$) | 191 | 45.8 | 4.64 |
| Ethane ($C_2H_6$) | 305 | 48.2 | 4.88 |
| Carbon Dioxide ($CO_2$) | 305 | 72.9 | 7.39 |
| Ammonia ($NH_3$) | 406 | 112 | 11.35 |
| Water ($H_2O$) | 647 | 218 | 22.1 |
| Hydrogen Sulfide ($H_2S$) | 373 | 89.5 | 9.07 |

As alluded to above, conditions with the reactor are adjusted such that at least one component therein becomes supercritical. That is, one of the components such as a component of the feedstock, lift gases, hydrogen, optional sulfiding agent, product vapors or water. Preferably, the conditions are made such that the water that is present becomes supercritical. Accordingly, the reactor may be at a temperature of at least 647 K and a pressure of at least 218 atm or 22.1 MPa. The supercritical water then will also present itself as an oxidizer and will degrade any lignins in the carbonaceous feedstock, where lignins may be understood as a complex polymer of aromatic alcohols which may have a composition of 63.4% carbon, 5.9% hydrogen and 0.7% ash and 30% oxygen.

It is noted that water vapors may also temporarily deactivate the catalyst by adhering to active sites on the catalyst, lowering its activity. The catalyst may be reactivated in the regenerator by the removal of the water from the active site. Therefore, the water would not accumulate on the catalyst during the run cycle or cause an increased deactivation rate with time as the process continues.

Water or steam in the reactor that may affect the catalyst can also be addressed with the addition of a deoxygenation catalyst that preferentially converts oxygen to products other than water. Suitable deoxygenation catalysts are similar to hydrotreating catalysts and may be selected from zeolites (ZSM-5 or others), Co/Mo, Ni/Mo, Ni, Co, Pd, Pt, Rh, or Ni/Cu, on $CeO_2$ or $ZrO_2$. The addition of methane and/or carbon monoxide in the lift gas combined with steam reforming catalyst will convert the water to hydrogen; or a blend of purposely designed catalysts and inert gas may be used to minimize the water effect on the catalyst(s). Additionally, to avoid introducing water into the system beyond the water created from pyrolysis, the biomass slurry could be made with an organic (not aqueous) compound or the carbonaceous feedstock can be added to the system without liquid using a system such as a high pressure lock hopper, auger or combination of auger and piston pump.

While the general process is outlined in FIG. 1 above, it should be noted that there are certain differences that may be considered as outlined in FIGS. 2 and 3 below.

Figure 2:
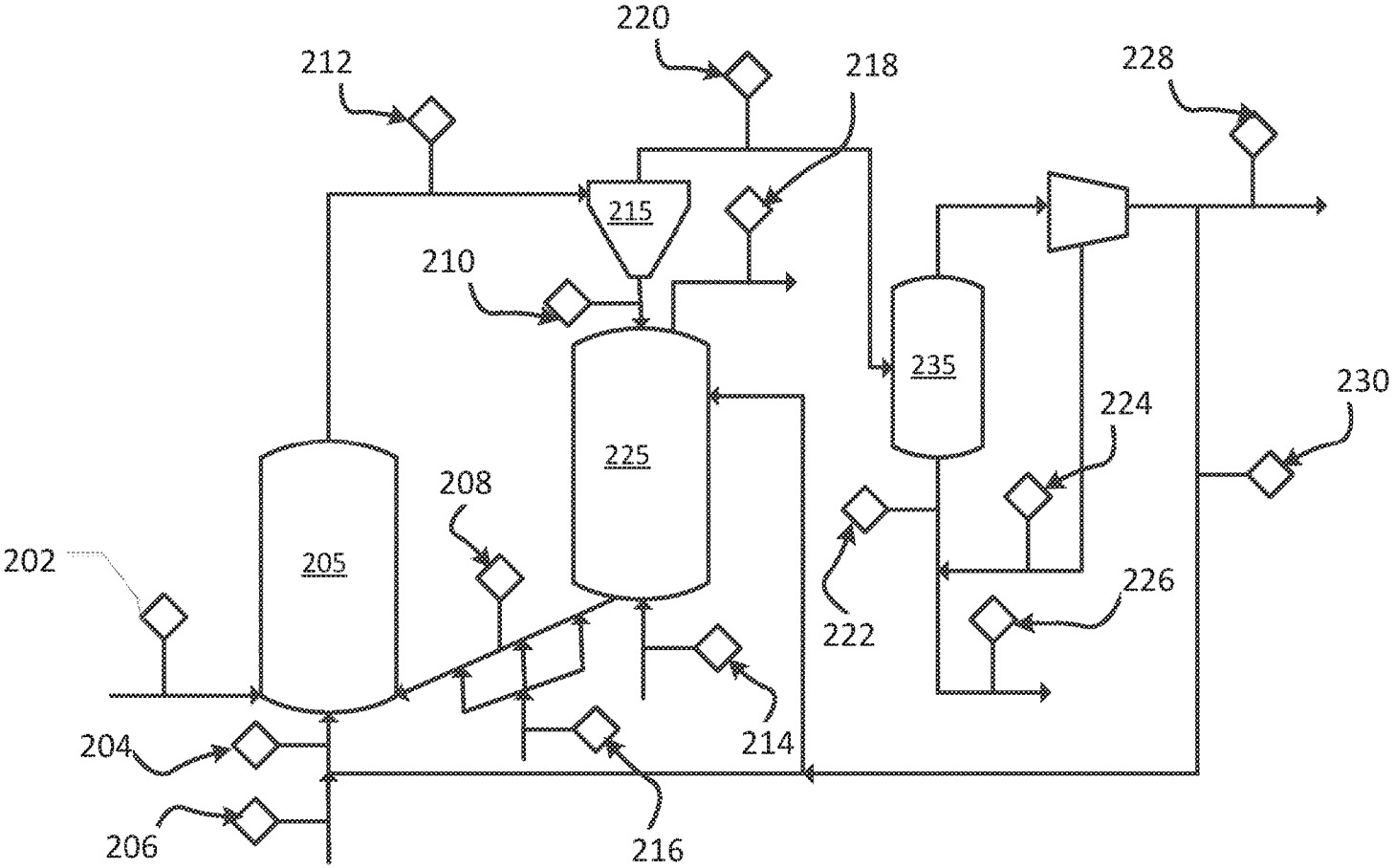
FIG. 2 is a diagrammatic representation of a manufacturing installation for conducting an embodiment of the process of the invention.

FIG. 2 next provides a schematic illustration of the present disclosure in more of a plant lay-out schematic style, as compared to FIG. 1. The carbonaceous feedstock 202, lift gas 204, and hydrogen or methane 206 are introduced through their respective inlets in what may identified as a reactor/riser 205 that uses a fluidized bed 208 of a mixture of particulate solids and catalyst(s) (any type of catalysts that improves hydrogenation may be used) with heat and high pressure, such as required for establishing supercritical conditions, to simultaneously conduct pyrolysis, hydropyrolysis, hydrotreating, and optionally reforming. The reactor/riser 205 elevates the fluidized bed and entrains with it the carbonaceous feedstock 202 from the bottom of the reactor 205 to the top to an outlet for the solid, liquid, and gas product mixture 212. Vapors and liquids 220 generated from the pyrolysis of the feedstock are entrained by the gas mixture, composed of the lift gas 204, hydrogen or methane 206 and steam to a cyclone separator 215 along with the fluidized bed 208 where the solids 210 are separated from the liquids and vapors 220. The solids 210 are then introduced in a regenerator 225 where pyrolysis byproducts, such as latent carbon in ash and coke are burned to generate heat, and then the regenerated fluidized bed 208 is recirculated to the reactor/riser 205. The fluidized bed of solids/catalyst 208 retains heat generated from the regenerator 225 and transfers the heat to the reactor/riser 205 where the carbonaceous feedstock processing takes place.

The regenerator may have a residence time of 1 to 20 minutes. More specifically, for a relatively low residence time, the range will be 1 to 4 minutes. For a relatively long residence time the range will be 6 to 20 minutes. The regenerator provides conditions to burn off the coke on the catalyst/heat carrier and on the coke-on-ash produced from the hydropyrolysis of the carbonaceous feedstock or slagging of the ash. Such residence time and/or optimally designed regenerator with a blend of inert gas with air or oxygen helps minimize sintering of the catalyst. Product gas routed to the regenerator creates additional heat for the catalyst/inert thermal carrier to absorb. The burning of the excess product gas in the regenerator may reduce sulfur emissions 218 by transforming hydrogen sulfide, which would otherwise be burnt at a flare thus releasing $SO_x$ emissions into the atmosphere, into sulfur dioxide, which can then be captured in a scrubber. High-sulfur feeds may provide the source of the catalyst-regenerating gases. Air, oxygen, or dilute air 214 enters the regenerator preferably through specifically designed distribution nozzle to fluidize the inert solids/catalyst mixture. Multiple distribution nozzles throughout the regenerator or a single distribution nozzle may be used plus motorized distribution of the solids (such as with an auger or a moving belt) as needed by the feedstock introduction method.

The mixture of catalysts and inert solids may be selected to have similar particle size and particle density for an even distribution throughout the system. For example, the average particle size of the inert solids and average particle size of the inert solids may be within +/−30% of one another. Similarly, the average particle density of the inert solids and catalyst may also be within +/−20% of one another.

As metals and coke byproducts of the pyrolysis of the carbonaceous feedstock accumulate on the solids/catalyst(s) of the fluidized bed 208 and may cause catalyst deactivation, any metal may sink to the bottom of the fluidized bed 208 where they may be removed from the system. One or more lateral equipment fixtures or standpipes may then remove the contaminated catalyst and/or return the fluidized inert solids/catalyst 208 mixture to the reactor/riser 205.

Hydrogen gas, recycled hydrogen gas from the gas mixture 230, methane gas, recycled methane gas from the gas mixture 230, carbon monoxide, recycled carbon monoxide from the gas mixture 230, or a product gas blend of inert components, steam, and produced hydrocarbons may be used as a component of the lift gas 204 in the reactor/riser 205.

As alluded to above, the carbonaceous feedstock 202 may enter into the system at different points of the reactor to control reactions and residence times, but preferably may be introduced at the bottom of the reactor/riser 205. The carbonaceous feedstock 202 enters into the reactor/riser 205 forming relatively high-pressure up-flow liquid/vapor phase slurry of reactants in atomized feed droplets/solids. The carbonaceous feedstock 202 will pyrolize or react in contact with the catalyst to form oil or a fuel component, which then forms the vapor phase. The products 212 containing the product vapors 220, inert solids/catalyst(s) 208, and ash/coke 210 are separated in a single cyclone or multiple cyclones 215. The flue gas from the regenerator 218 is removed and sent to a scrubber and the steam converted to water. The product vapors 220 continue overhead to a quench system 235. Vapors 224 may be condensed and mixed with the liquid product 222 to form combined quenched materials 226. The combined quenched materials 226 may be used as is, or sent to a distillation system to separate the various components, or the quenched materials 226 may be recycled as co-feed. In the cyclone 215, the inert solids/catalyst(s) 208 and coke-on-ash 210 falls to the regenerator where the free coke burns along with the product gas and adhering coke, providing heat to the system. Excess gas and steam 228 may be removed from the system, and remaining gas 230 may be recycled into the lift gas 204 back into the reactor/riser 205 or regenerator 225. An exemplary composition of a portion of the recycled gas 230 is detailed in Table 2.

TABLE 2

Recycled Gas Composition

| Gas | Wt. fraction | Mol. frac. |
|---|---|---|
| $CH_4$ | 0.19 | 0.2596 |
| $H_2$ | 0.04 | 0.2235 |
| CO | 0.47 | 0.3577 |
| $C_2H_4$ | <0.01 | 0.0018 |
| $C_3H_8$ | <0.01 | 0.0002 |
| $C_3H_6$ | <0.01 | 0.0014 |
| $C_4$-hydrocarbons | 0.03 | 0.0144 |
| $CO_2$ | 0.21 | 0.1035 |
| Nitrogen | 0.05 | 0.0379 |

To counter any catalyst poisoning from water formation, a sulfiding agent 216, such as hydrogen sulfide, dimethylsulfide, dimethyl disulfide (DMDS), carbon disulfide, may be provided to the fluidized bed 208 before recycling into the reactor/riser 205. Steam-reforming catalyst may be used to convert the steam to hydrogen or alternatively a deoxygenation catalyst to react oxygen to form components other than water.

Figure 3:
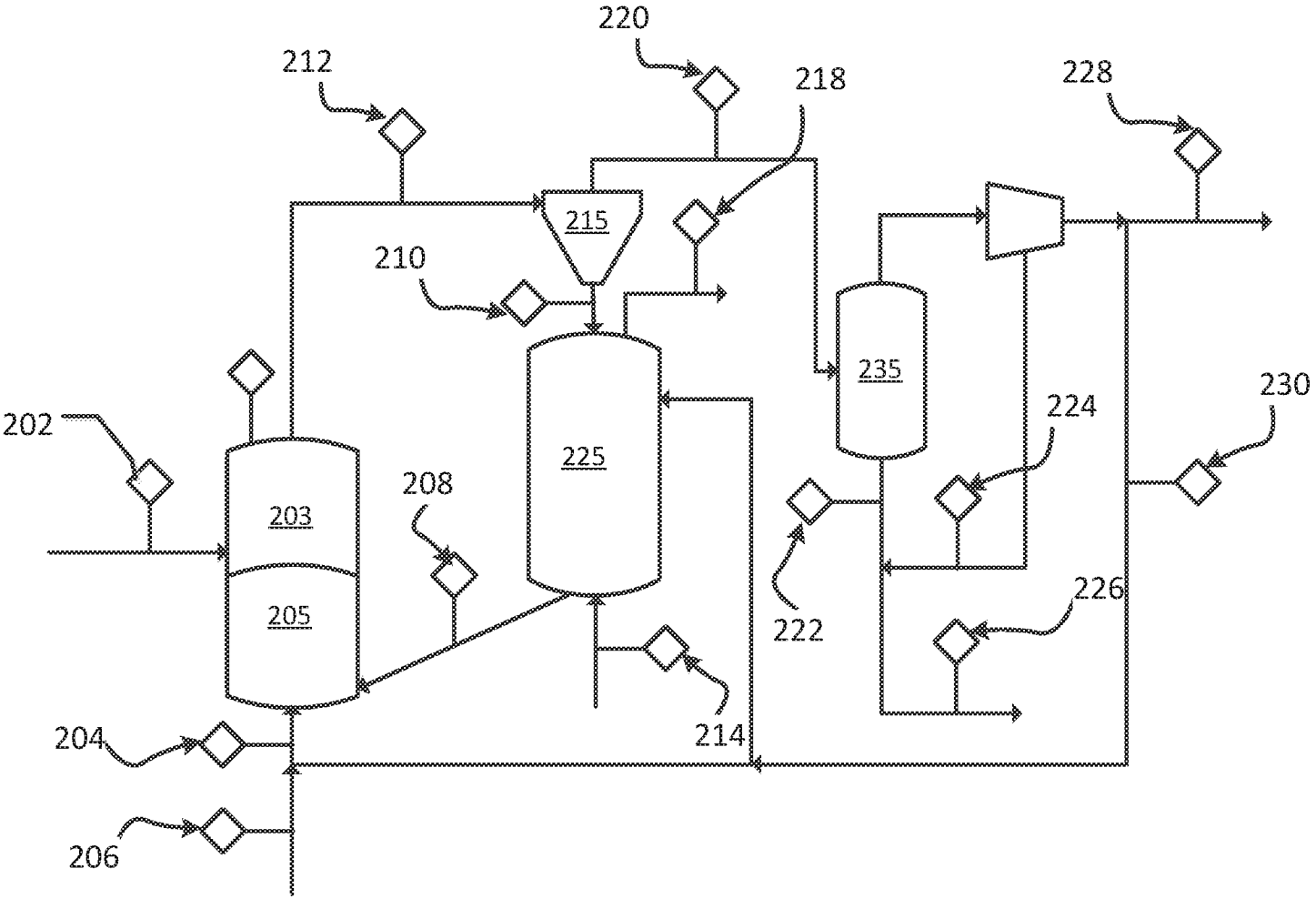
FIG. 3 is a diagrammatic representation of a manufacturing installation for conducting an embodiment of the process of the invention.

Referring to FIG. 3, the introduction of the herein described sulfiding agent may take place in a lower portion 205, in a first phase, of the reactor/riser 203,205. The carbonaceous feedstock may also itself enter into the system at different points of the reactor/riser 203,205, such as at the midsection 203.

Figure 4:
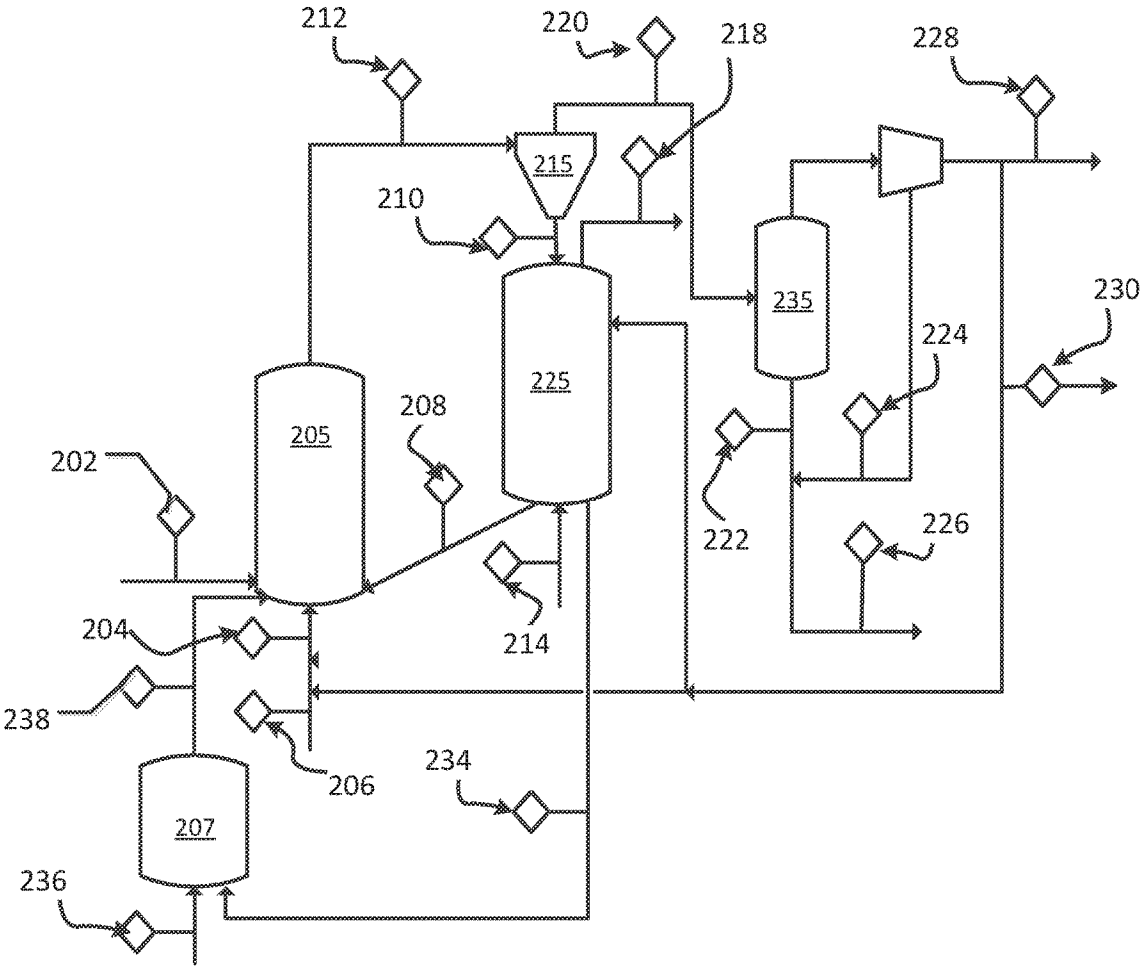
FIG. 4 is a diagrammatic representation of a manufacturing installation for conducting an embodiment of the process of the invention.

Referring to FIG. 4, it is noted that as metals and coke accumulate on the catalyst and cause catalyst deactivation, the metals sink to the bottom of the fluidized bed in the regenerator 225 where they may be removed from the system. One or more lateral equipment components or standpipes remove the contaminated catalyst and/or split the fluidized inert solids/catalyst sending part of the mixture 208 to the reactor/riser 205 and part of the mixture 234 to a catalyst regenerator 207. A sulfiding agent 236 such as hydrogen sulfide, dimethyl sulfide, dimethyl disulfide (DMDS), or hydrogen sulfide from the reaction products and hydrogen gas or hydrogen gas blend may be used as lift gas 204 to sulfide the catalyst(s) in the catalyst regenerator 207. After being sulfided, the regenerated catalyst 238 may flow back to the reactor/riser 205 with the inert solids/catalyst from the primary regenerator 225.

Finally, below are product distributions identified via modeling studies for the feedstock conversions herein with respect to the differently identified feedstocks:

TABLE 3

Projected mass balance for each feed*

| | INPUT (wt %) | Gas (wt %) | Liquid Oil (wt %) Naphtha | Jet | Gasoline | Diesel | VGO | TOTAL Liquid | Char/Ash (wt %) |
|---|---|---|---|---|---|---|---|---|---|
| Feedstock A | 100 | 29.9 | 0.4 | 10.8 | 1.7 | 38.3 | 1.6 | 52.8 | 17.3 |
| Feedstock B | 100 | 74.2 | 0.1 | 3.7 | 0.6 | 14.3 | 0.6 | 19.2 | 6.5 |
| Feedstock C | 100 | 33.1 | 0.3 | 9.1 | 1.4 | 36.2 | 1.4 | 48.4 | 18.6 |

*Includes moisture content as part of the feed. Assumes moisture goes to "Gas" column. Assumes 6% moisture in Feedstock A, 65% moisture in Feedstock B, and 11% moisture in Feedstock C. All feedstocks are agricultural materials and residuals. VGO is reference to vacuum gas oils that amount to relatively heavy oils typically left-over from petroleum distillation.

TABLE 4

Projected mass balance on a dry basis.

| | INPUT (wt %) | Gas (wt %) | Liquid Oil (wt %) Naphtha | Jet | Gasoline | Diesel | VGO | TOTAL Liquid | Char/Ash (wt %) |
|---|---|---|---|---|---|---|---|---|---|
| Feedstock A | 100 | 25.4 | 0.4 | 11.5 | 1.8 | 40.7 | 1.7 | 56.1 | 18.5 |
| Feedstock B | 100 | 25.3 | 0.4 | 10.7 | 1.7 | 41.4 | 1.6 | 55.8 | 18.9 |
| Feedstock C | 100 | 24.6 | 0.4 | 10.2 | 1.6 | 40.7 | 1.5 | 54.4 | 20.9 |

The projected mass balance was based on an Arrhenius lump kinetic model using literature values for kinetic data. The lignin, protein, and oil components of the feedstock were modeled using the lump kinetic model to determine gas, liquid oil, and char content. Water content that did not react (approximately 13 wt. % of the gas product) is listed with the gas product. Ash content in the feedstock was assumed to remain ash in the product.

To determine the liquid oil content, literature values of a product distribution for lignin biomass were used to determine the liquid oil distribution for the lignin, cellulose, and protein (0.79 wt. % naphtha, 21.34 wt. % jet, 71.35 wt. % diesel, 3.21 wt. % VGO). The liquid product from the oil extractives of the feedstock were assumed to become diesel based on their carbon number.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A process for the production of fuel product components comprising:

(a) providing in a reaction vessel a carbonaceous feedstock, a lift gas mixture of inert gas components, hydrogen, water, methane, a fluidized bed of inert particulate solids, a steam reformation catalyst, and a hydrogenation catalyst; and (b) simultaneously (1) pyrolyzing and hydrotreating the carbonaceous feedstock to form said fuel product components and (2) steam reforming said methane to form carbon monoxide and hydrogen under a temperature and pressure such that at least one of the carbonaceous feedstock, lift gas mixture of inert gas components, hydrogen, water, or fuel product components is a supercritical fluid, wherein:

(i) said pressure is at least 22.1 MPa, (ii) the carbonaceous feedstock has a residence time in said reaction vessel of less than or equal to 5.0 seconds, and (iii) the steam reformation catalyst comprises a Ni-M composition, wherein M is selected from the group consisting of gold, silver, tin, copper, cobalt, iron, gadolinium, and boron.

2. The process of claim 1 wherein the simultaneous pyrolysis, hydrotreatment, and steam reforming takes place at a temperature of at least 647 K.

3. The process of claim 1 wherein said carbonaceous feedstock has a water content of 0% by weight to 97% by weight.

4. The process of claim 1 wherein said fuel product components have an oxygen level of less than or equal to 1000 ppm, a nitrogen level of less than or equal to 15 ppm and a sulfur level of less than or equal to 3000 ppm.

5. The process of claim 1 wherein the inert particulate solids are selected from the group consisting of silica, sand, alumina, silicon, ceramics, zeolites, $CeO_2$, $ZrO_2$, carbon, $TiO_2$, oxides or carbonates of Na, oxides or carbonates of K, and oxides or carbonates of Mg.

6. The process of claim 5 wherein said inert particulate solids have a particle size of 50 μm to 500 μm.

7. The process of claim 1 wherein the hydrogenation catalyst is a zirconium/platinum alloy or a zirconium/palladium alloy.

8. The process of claim 1 wherein the hydrogenation catalyst is selected from the group consisting of Pt—Cu, Ni—Cu, $CoMoS_2$, $NiMoS_2$, $MoO_3$, $CrO_3$, $WO_3$, $ZrO_2$, and transition metals.

9. The process of claim 1 wherein said pyrolyzing comprises hydropyrolysis.

10. A process for the continuous production of biofuel product components comprising:

(a) providing in a reaction vessel a carbonaceous feedstock, a lift gas mixture of inert gas components, hydrogen, water, methane, a fluidized bed of inert particulate solids, a steam reformation catalyst, and a hydrogenation catalyst;

(b) simultaneously (1) pyrolyzing and hydrotreating the carbonaceous feedstock to form said biofuel product components and (2) steam reforming said methane to form carbon monoxide and hydrogen under a temperature and pressure such that at least one of the carbonaceous feedstock, lift gas mixture of inert gas components, hydrogen, water, or biofuel product components is a supercritical fluid, wherein said biofuel product components include solid, liquid, and gas products, wherein said pressure is at least 22.1 MPa, and wherein the carbonaceous feedstock has a residence time in said reaction vessel of less than or equal to 5.0 seconds;

(c) separating said solid products from said liquid and gas products; and (d) burning said solid products and recovering heat, wherein said heat is transferred to said reaction vessel, wherein the steam reforming catalyst comprises a Ni-M composition, wherein M is selected from the group consisting of gold, silver, tin, copper, cobalt, iron, gadolinium, and boron.

11. The process of claim 10 wherein the simultaneous pyrolysis, hydrotreatment, and steam reforming takes place at a temperature of at least 647 K.

12. The process of claim 10 wherein said carbonaceous feedstock has a water content of 0% by weight to 97% by weight.

13. The process of claim 10 wherein said biofuel product components have an oxygen level of less than or equal to 1000 ppm, a nitrogen level of less than or equal to 15 ppm and a sulfur level of less than or equal to 3000 ppm.

14. The process of claim 10 wherein the inert particulate solids are selected from the group consisting of silica, sand, alumina, silicon, ceramics, zeolites, $CeO_2$, $ZrO_2$, carbon, $TiO_2$, oxides or carbonates of Na, oxides or carbonates of K, and oxides or carbonates of Mg.

15. The process of claim 14 wherein said inert particulate solids have a particle size of 50 μm to 500 μm.

16. The process of claim 10 wherein the hydrogenation catalyst is a zirconium/platinum alloy or a zirconium/palladium alloy.

17. The process of claim 10 wherein the hydrogenation catalyst is selected from the group consisting of Pt—Cu, Ni—Cu, $CoMoS_2$, $NiMoS_2$, $MoO_3$, $CrO_3$, $WO_3$, $ZrO_2$, and transition metals.

18. The process of claim 10 wherein said pyrolyzing comprises hydropyrolysis.

19. A process for the production of fuel product components comprising:

(a) providing in a reaction vessel a carbonaceous feedstock having a water content of 0.1% by weight to 50% by weight, a lift gas mixture of inert gas components, hydrogen, water, methane, a fluidized bed of inert particulate solids, a steam reformation catalyst, and a hydrogenation catalyst;

(b) simultaneously (1) pyrolyzing and hydrotreating the carbonaceous feedstock to form said fuel product components and (2) steam reforming said methane to form carbon monoxide and hydrogen under a temperature of at least 647 K and pressure of at least 22.1 MPa wherein said carbonaceous feedstock has a residence time in said reaction vessel of less than or equal to 5.0 seconds, wherein the steam reformation catalyst comprises a Ni-M composition, wherein M is selected from the group consisting of gold, silver, tin, copper, cobalt, iron, gadolinium, and boron.

20. The process of claim 19 wherein said pyrolyzing comprises hydropyrolysis.

* * * * *